US007527343B2

(12) United States Patent
Oh et al.

(10) Patent No.: US 7,527,343 B2
(45) Date of Patent: May 5, 2009

(54) REFRIGERATOR HAVING BASKET LIFT APPARATUS

(75) Inventors: Seung-Hwan Oh, Gyeonggi-Do (KR); Kyung-Han Jeong, Seoul (KR); Sang-Oh Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 528 days.

(21) Appl. No.: 11/028,634

(22) Filed: Jan. 5, 2005

(65) Prior Publication Data

US 2006/0042305 A1 Mar. 2, 2006

(30) Foreign Application Priority Data

Jul. 16, 2004 (KR) ..... 10-2004-0055692
Jul. 16, 2004 (KR) ..... 10-2004-0055704

(51) Int. Cl.
*A47B 96/04* (2006.01)

(52) U.S. Cl. ..... 312/402; 312/325; 312/319.5

(58) Field of Classification Search ..... 312/310, 312/402, 404, 298, 301, 292, 312, 319.5–319.8, 312/302, 303, 325, 334.2, 334.3, 330.1, 405.1, 312/321.5

See application file for complete search history.

(56) References Cited

U.S. PATENT DOCUMENTS 1,993,885 A * 3/1935 Horwitt ..... 221/55
2,088,719 A * 8/1937 Pierson ..... 312/269
2,319,651 A * 5/1943 Wilkinson et al. ..... 126/340
2,525,201 A * 10/1950 Beynon et al. ..... 126/340
2,819,141 A * 1/1958 Myer ..... 312/303
3,010,773 A * 11/1961 Cotton et al. ..... 312/25
3,195,969 A * 7/1965 Wallen ..... 312/269
3,212,835 A * 10/1965 Beckett et al. ..... 312/311
3,246,939 A * 4/1966 Petkwitz et al. ..... 312/274
3,862,788 A * 1/1975 Hock et al. ..... 312/294
4,087,140 A * 5/1978 Linstromberg ..... 312/292
5,273,352 A * 12/1993 Saper ..... 312/7.2
5,586,816 A 12/1996 Geiss, II
6,055,823 A * 5/2000 Baker et al. ..... 62/265
6,447,083 B1 * 9/2002 Chiapetta et al. ..... 312/404
6,510,858 B1 * 1/2003 Halstead et al. ..... 134/57 D
2004/0100168 A1 * 5/2004 Choi ..... 312/296
2005/0073225 A1 4/2005 Kwon et al.
2006/0043848 A1 * 3/2006 Jeong et al. ..... 312/310

FOREIGN PATENT DOCUMENTS

DE 297 01 227 U1 6/1997
JP 1-106894 U 7/1989
JP 05-296647 A 11/1993
KR 100159711 B1 8/1998

* cited by examiner

*Primary Examiner*—Janet M Wilkens
(74) *Attorney, Agent, or Firm*—Birch, Stewart, Kolasch & Birch, LLP

(57) ABSTRACT

A refrigerator having a basket lift apparatus comprises: a body having cooling chambers for storing food; a frame accommodated in the cooling chamber arranged at a lower portion of the body in a slidable manner; a basket placed on the frame and for storing food; a door positioned at a front side of the frame and hinge-connected to the frame; a first link hinge-connected between the frame and the basket; a second link hinge-connected between the first link and the door; and a driving unit for rotating the first link in order to lift the basket. When the basket arranged at the lower portion of the body is opened, the basket is lifted up thereby to enhance a user's convenience.

26 Claims, 14 Drawing Sheets

REFRIGERATOR HAVING BASKET LIFT APPARATUS

BACKGROUND OF THE INVENTION

1. Field of the Invention

The present invention relates to a refrigerator, and more particularly, to a refrigerator having a basket lift apparatus capable of enhancing a user's convenience by lifting a basket installed at a lower portion of a body when the basket is drawn out of a lower cooling chamber.

2. Description of the Conventional Art

FIG. 1 is a perspective view showing a refrigerator in accordance with the conventional art, and FIG. 2 is a sectional view of a refrigerator showing a state that a basket is accommodated in a body.

The conventional refrigerator comprises: a body 102 having an opened front side and an accommodation space; an upper cooling chamber 106 arranged at an upper side of the body 102 and having a pair of upper doors 104 opened to both sides, for storing food; and a lower cooling chamber 112 arranged at a lower side of the body 102, separated from the upper cooling chamber 106 by a partition wall 108, and having a lower door 110 opened in a slidable manner.

A mechanical chamber 116 having a compressor 114 for generating cold air to be supplied to the upper cooling chamber 106 and the lower cooling chamber 112, etc. is installed at a rear side of the body 102.

A basket 120 for accommodating freezing items is arranged at the lower cooling chamber 112 to be slidable back and forth, and the lower door 110 is fixed at a front side of the basket 120. According to this, when the lower door 110 is pulled, the basket 120 is opened, and when the lower door 110 is pushed, the basket 120 is closed. A guide rail 124 is installed between an inner side surface of the basket 120 and an inner side surface of the lower cooling chamber 112, thereby guiding the basket 120 to be slidable back and forth.

A plurality of drawers for storing food are installed at an upper side of the basket 120 to be opened in a slidable manner.

In the conventional refrigerator, when a user forwardly pulls the lower door 110 in order to take out the food stored in the lower cooling chamber 112 or in order to accommodate food in the lower cooling chamber 112, the basket 120 is opened with a slide motion. Also, when the user backwardly pushes the lower door 110 after taking out the food stored in the basket 120 or accommodating food in the basket 120, the basket 120 is closed with a slide motion.

However, in the conventional refrigerator, since the basket is arranged at a lower portion of the refrigerator, the user has to bend his or her waist or has to crouch in order to take out the food stored in the basket or to accommodate food in the basket thereby to have inconvenience in using the basket.

SUMMARY OF THE INVENTION

Therefore, an object of the present invention is to provide a refrigerator having a basket lift apparatus capable of enhancing a user's convenience by elevating a position of a basket by lifting the basket when the basket arranged at a lower portion of a body is drawn out.

To achieve these and other advantages and in accordance with the purpose of the present invention, as embodied and broadly described herein, there is provided a refrigerator having a basket lift apparatus comprising: a body having cooling chambers for storing food; a frame accommodated in the cooling chamber arranged at a lower portion of the body in a slidable manner; a basket placed on the frame and for storing food; a door hinge-connected to the frame; a first link hinge-connected between the frame and the basket, for supporting a lifted state of the basket; and a second link hinge-connected between the first link and the door, for lifting the basket when the door is rotated.

At least one first link having one end portion hinge-connected to a lower end of the frame and another end portion hinge-connected to a lateral surface of the basket is provided.

A spring for providing an elastic force to the first link in a direction that the basket is lifted is installed at the hinge connection portion of the first link.

The second link has one end portion hinge-connected to a middle portion of the first link, and another end portion hinge-connected to an upper side of the door.

The refrigerator having a basket lift apparatus further comprises a locking unit for locking the door to the frame so that the door can not be rotated or releasing a locked state of the door. The locking unit is composed of: a locking hole formed at a front side of the frame; a locking hook movably mounted at the door thus to be locked in the locking hole; and a spring for providing an elastic force to the locking hook so that the locking hook can maintain a locked state in the locking hole.

The refrigerator having a basket lift apparatus further comprises a stopping unit installed between the frame and the door and preventing the door from being returned to the original state after a rotation. The stopping unit is composed of: a rod rotatably connected to a rear surface of the door and having a certain length; a stopping hole formed at the frame and passing the rod; and a stopping protrusion formed at the end of the rod thus to be stopped in the stopping hole.

The refrigerator having a basket lift apparatus comprises: a body having cooling chambers for storing food; a frame accommodated in the cooling chamber arranged at a lower portion of the body in a slidable manner; a basket placed on the frame and for storing food; a door positioned at a front side of the frame and hinge-connected to the frame; a first link hinge-connected between the frame and the basket; a second link hinge-connected between the first link and the door; and a driving unit for rotating the first link in order to lift the basket.

The driving unit is composed of: a driving motor mounted at the frame and generating a driving force; and a power transmitting unit for transmitting a driving force generated from the driving motor to a hinge shaft to which the first link is connected.

The power transmitting unit is composed of: a driving gear fixed to a rotation shaft of the driving motor and rotated together with the rotation shaft; and a driven gear gear-engaged with the driving gear and fixed to the hinge shaft.

The refrigerator having a basket lift apparatus further comprises a controlling unit for controlling the driving unit according to a user's adjustment. The controlling unit is composed of: a switch mounted at the door and adjusted by a user; a first sensor for sensing a state that the basket is lifted to the maximum; a second sensor for sensing a state that the basket is descended to the maximum; and a controller for controlling an operation of the driving motor according to a signal applied from the switch, the first sensor, and the second sensor.

The first link is constructed as one pair arranged in parallel to each other, and one first link is longer than another first link.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a refrigerator having a basket lift apparatus will be explained in more detail with reference to the attached drawings.

Even if there may exist a plurality of preferred embodiments of the refrigerator having a basket lift apparatus according to the present invention, the most preferred embodiment will be explained hereinafter.

Figure 1:
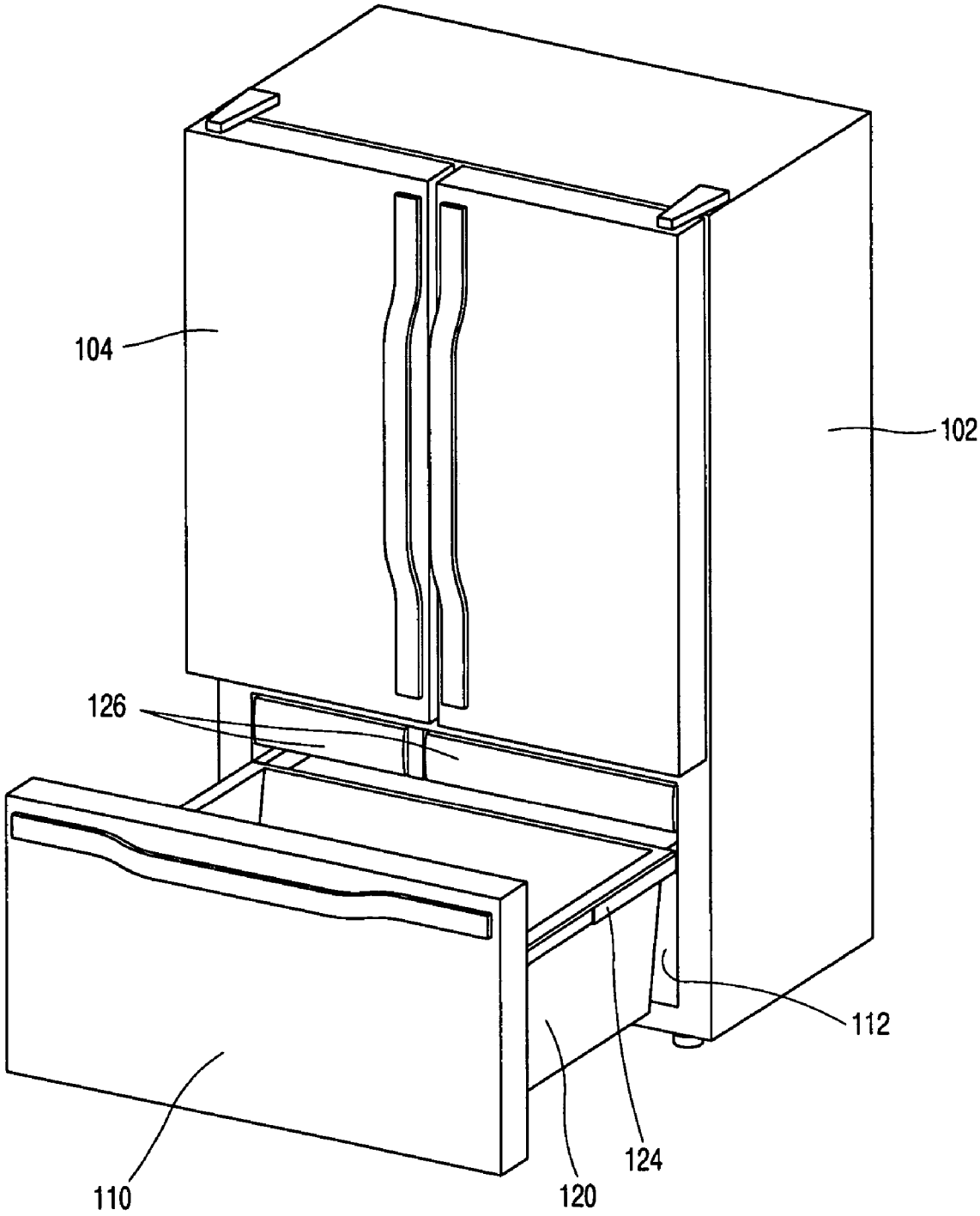
FIG. 1 CONVENTIONAL ART
FIG. 1 is a perspective view of a refrigerator in accordance with the conventional art.
Figure 2:
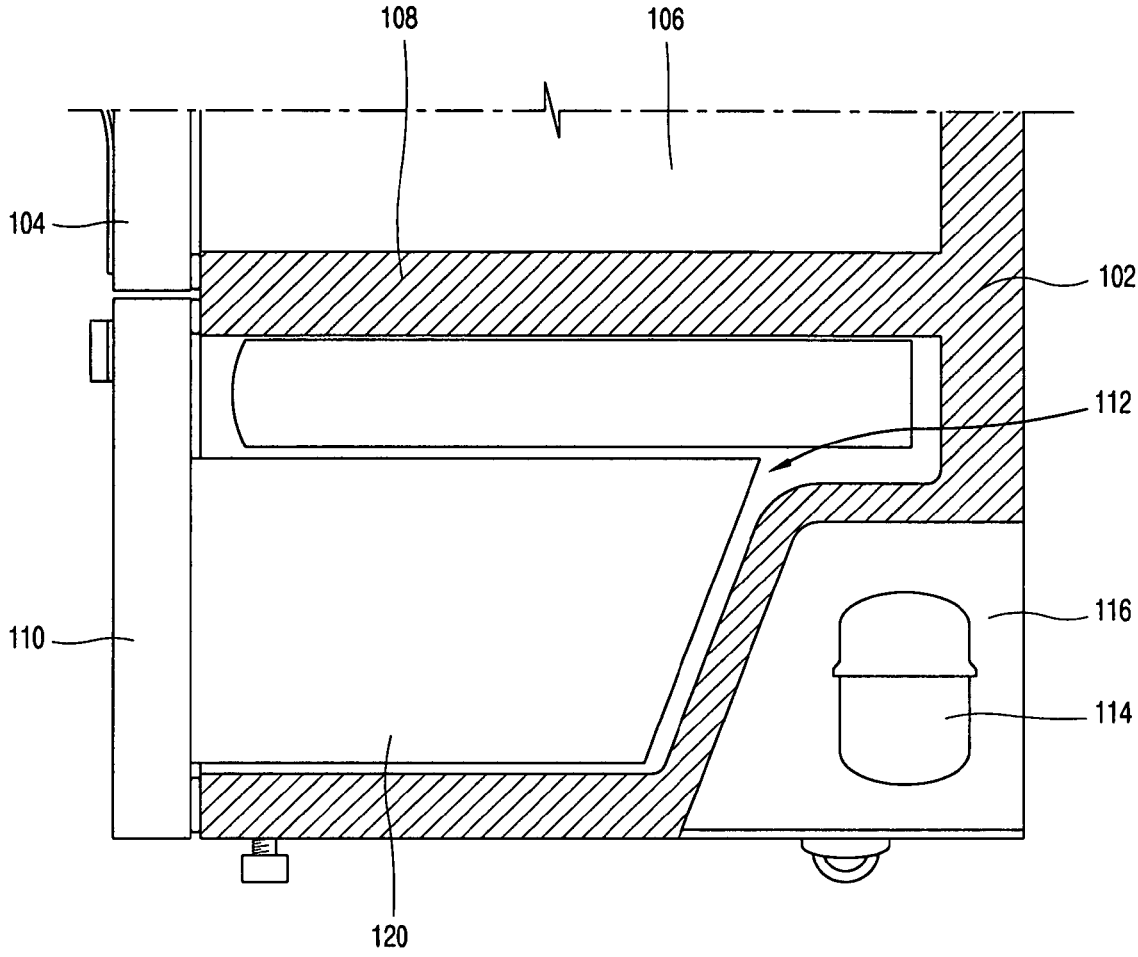
FIG. 2 CONVENTIONAL ART
FIG. 2 is a sectional view showing a lower portion of the refrigerator in accordance with the conventional art.
Figure 3:
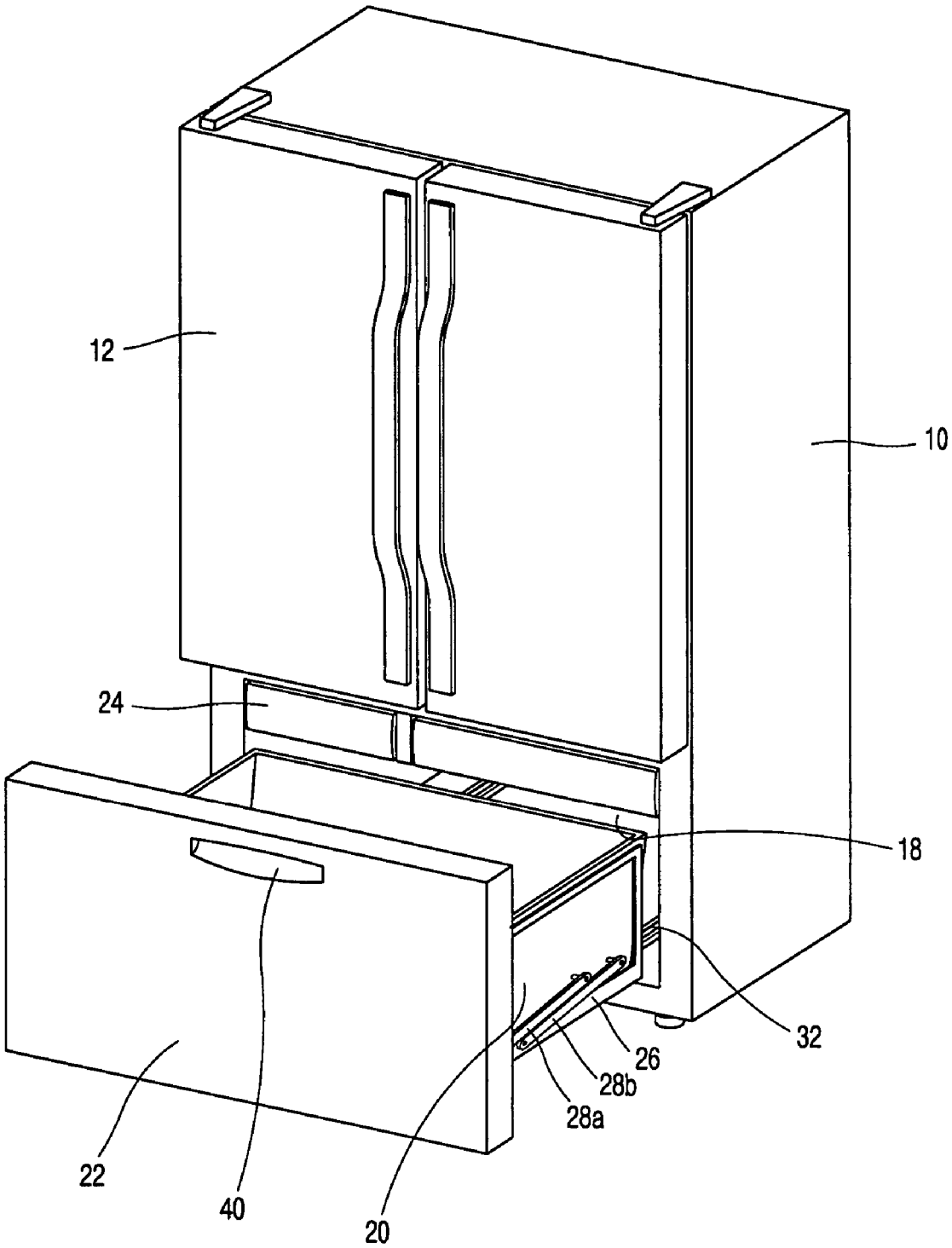
FIG. 3 is a perspective view of a refrigerator according to the present invention.
Figure 4:
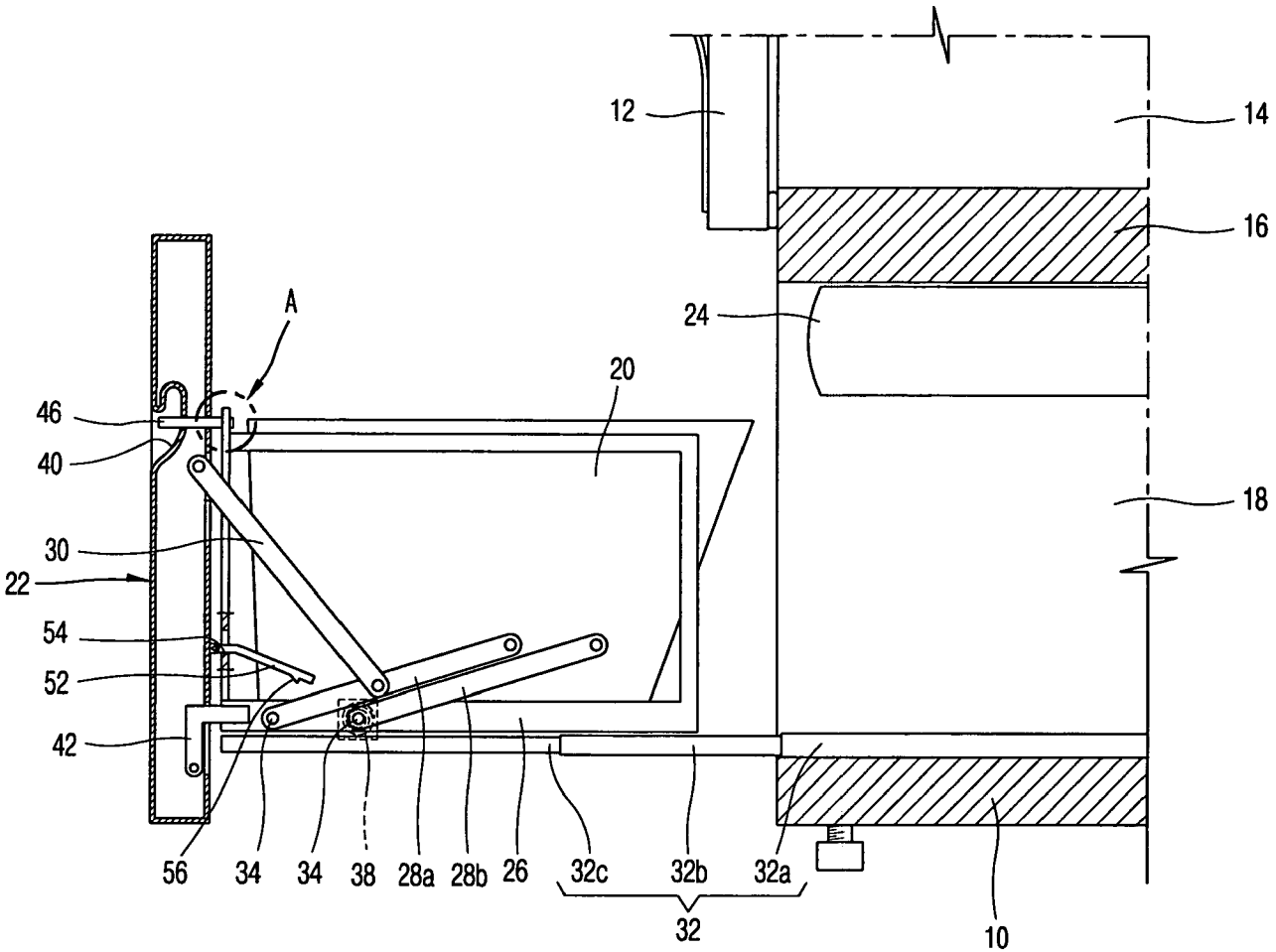
FIG. 4 is a sectional view showing a basket lift apparatus of the refrigerator according to the present invention.

FIG. 3 is a perspective view of a refrigerator according to the present invention, and FIG. 4 is a sectional view showing a basket lift apparatus of the refrigerator according to the present invention.

The refrigerator according to the present invention comprises: a body 10 having an accommodation space; an upper cooling chamber 14 arranged at an upper side of the body 10 and having a pair of upper doors 12 opened to both sides; a lower cooling chamber 18 arranged at a lower side of the body 10 and separated from the upper cooling chamber 14 by a partition wall 16; a basket 20 arranged at the lower cooling chamber 18 to be slidable back and forth, for storing food; and a basket lift apparatus for lifting up the basket 20 when the basket 20 is opened.

Preferably, the upper cooling chamber 14 is used a cooling chamber for storing refrigerating food items, and the lower cooling chamber 18 is used as a freezing chamber for storing freezing food items.

A lower door 22 for pushing the basket 20 or drawing the basket 20 out of the lower cooling chamber 18 along back and forth directions of the body 10 is arranged at a front side of the lower cooling chamber 18. A plurality of drawers 24 drawn out along back and forth directions of the body 10 and for storing food are installed at an upper side of the lower cooling chamber 18.

The basket lift apparatus includes: a frame 26 arranged at the lower cooling chamber 18 to be slidable back and forth, on which the basket 20 is placed, and to the front side thereof the lower door 22 is hinge-connected; a plurality of first links 28*a* and 28*b* hinge-connected between the basket 20 and the frame 26, for supporting a lifted state of the basket 20; and a four-joint link unit hinge-connected between one of the first links 28*a* and 28*b* and the lower door 22, for lifting the basket 20 when the lower door 22 is forwardly inclined.

The frame 26 has a square box shape having a space in which the basket 20 is placed, and a guide rail 32 for guiding the frame 26 to be slidable back and forth is installed between a lower surface of the frame 26 and a bottom surface of the lower cooling chamber 18.

The guide rail 32 is composed of: a fixed rail 32*a* fixed to a bottom surface of the lower cooling chamber 18; a middle rail 32*b* slidably connected to the fixed rail 32*a;* and a movable rail 32*c* slidably connected to the middle rail 32*b* and fixed to a bottom surface of the frame 26.

The first links 28*a* and 28*b* are arranged to have a certain inclination angle. One end portion of the first link is hinge-connected to a hinge shaft 34 formed at a lower end of the frame 26, and another end portion of the first link is hinge-connected to a hinge shaft 36 formed at a lower end of the basket 20. At least two first links 28*a* and 28*b* are installed to support a lifted state of the basket 20 when the basket 20 is lifted.

A spring 38 for providing a certain elastic force to the first link 28*b* is installed between one first link 28*b* of the first links 28*a* and 28*b* and the hinge shaft.

The spring 38 can be installed at the first link 28*a,* or can be installed at all the first links 28*a* and 28*b.*

The spring 38 is to provide an elastic force in a direction that the first link 28*b* is vertically arranged. The spring 38 provides an elastic force to the first link when the basket 20 is lifted, thereby facilitating to lift the basket 20. The spring 38 can be a spiral spring or a torsion spring.

A second link 30 is formed as a bar type having a certain length. One end portion of the second link is hinge-connected to a middle portion of the first link 28*a,* and another end portion thereof is hinge-connected to an upper end of the lower door 22.

The four-joint link unit is for lifting the basket 20 by using a principle of a lever. When the lower door 22 is forwardly pulled, the second link 30 hinge-connected to the lower door 22 is pulled. According to this, the first links 28*a* and 28*b* hinge-connected to the second link 30 are rotated thus to become upright. Then, the basket 20 hinge-connected to the first links 28*a* and 28*b* is forwardly moved and is lifted up.

The lower door 22 is provided with a hand grip 40 for pulling the lower door 22 at a front side thereof, and a lower portion of the lower door 22 is rotatably hinge-connected to a hinge bracket 42 fixed to the frame 26. A locking device for locking the lower door 22 to the frame 26 is mounted at an upper end of the lower door 22. Also, a stopping unit for preventing the lower door 22 that has been forwardly rotated from being returned to the original state is installed at a middle portion of the lower door 22.

Figure 5:
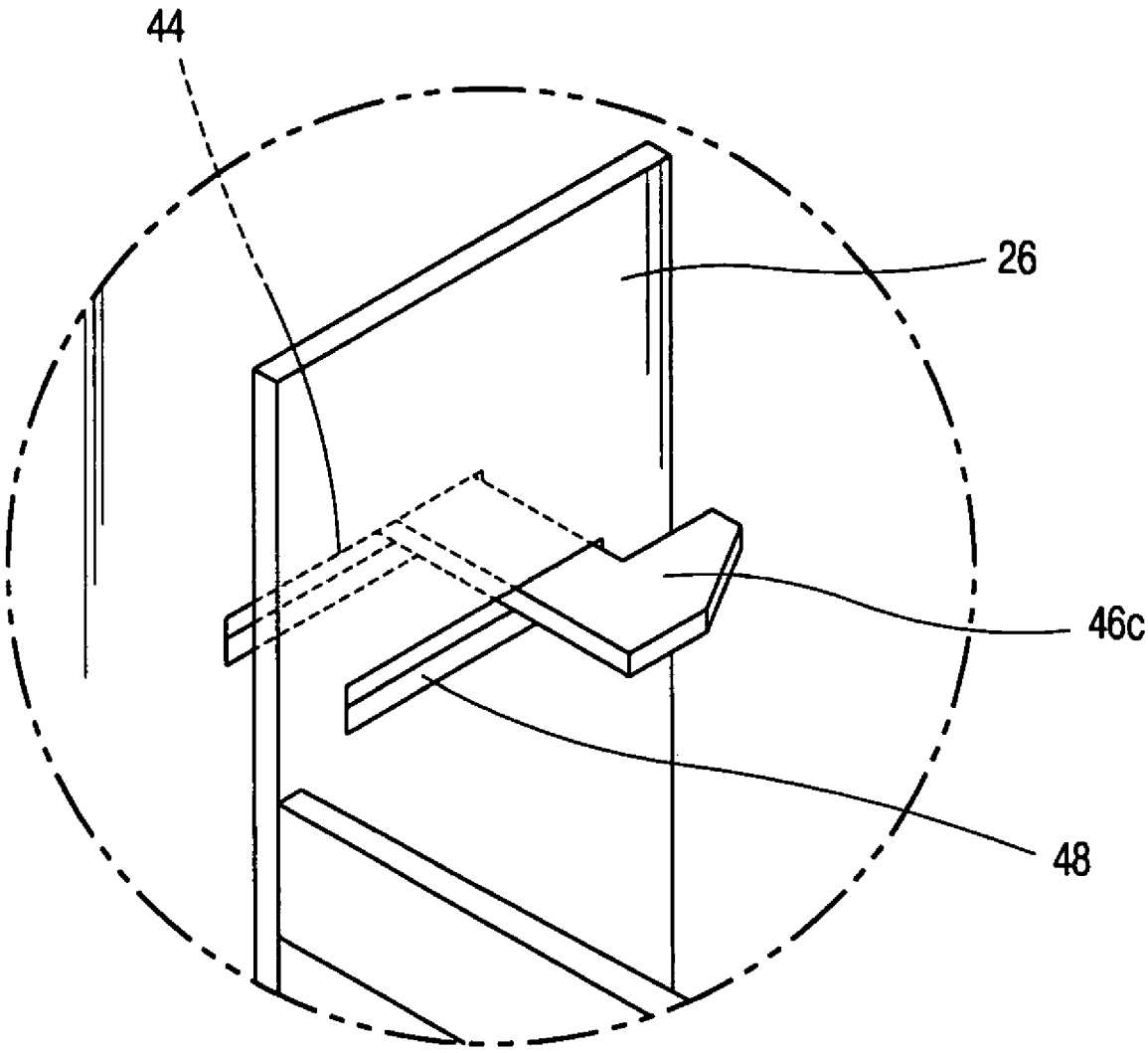
FIG. 5 is an enlargement view of 'A' part of FIG. 4.
Figure 6:
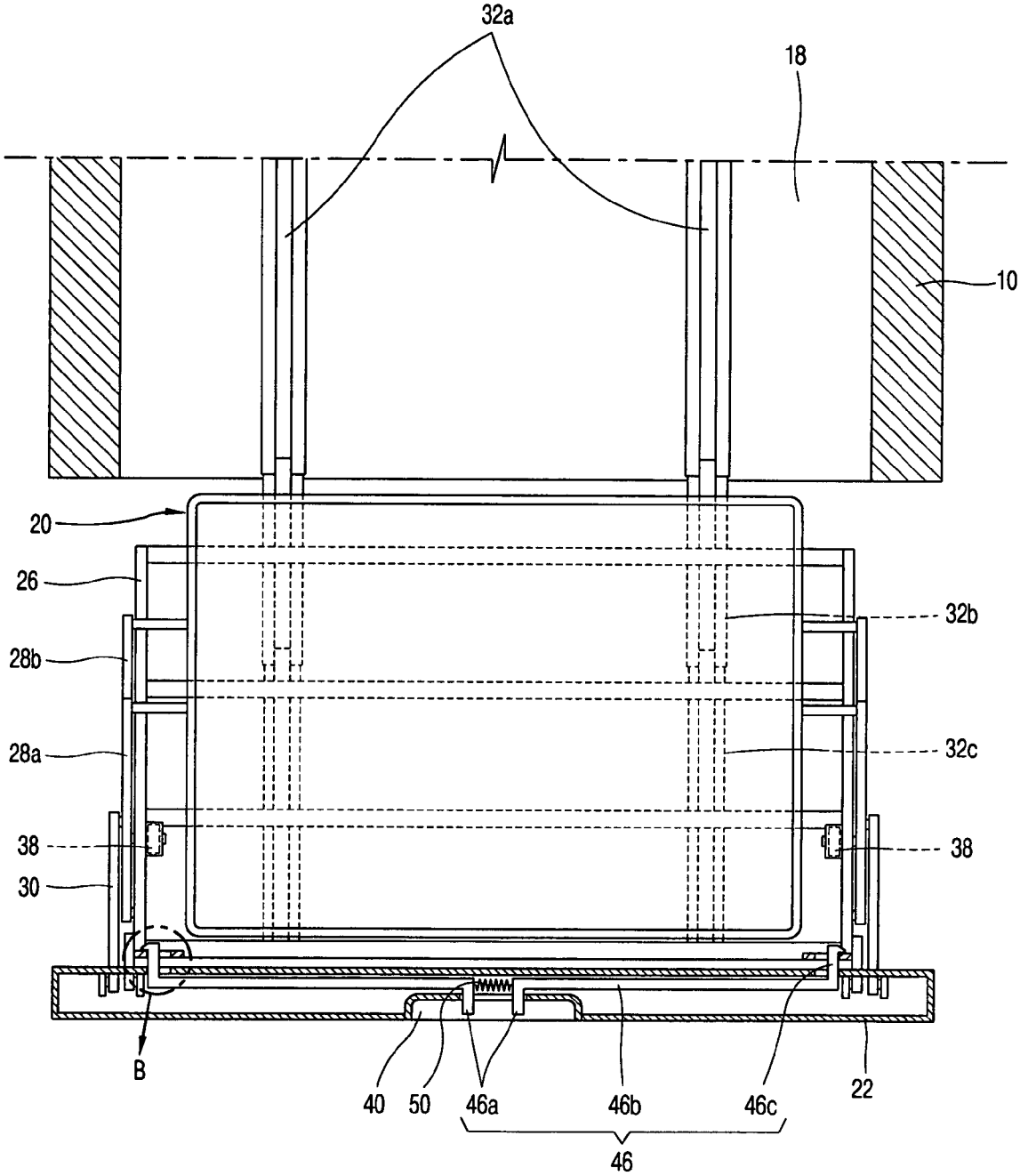
FIG. 6 is a horizontal section view showing a basket lift apparatus of a refrigerator according to one embodiment of the present invention.
Figure 7:
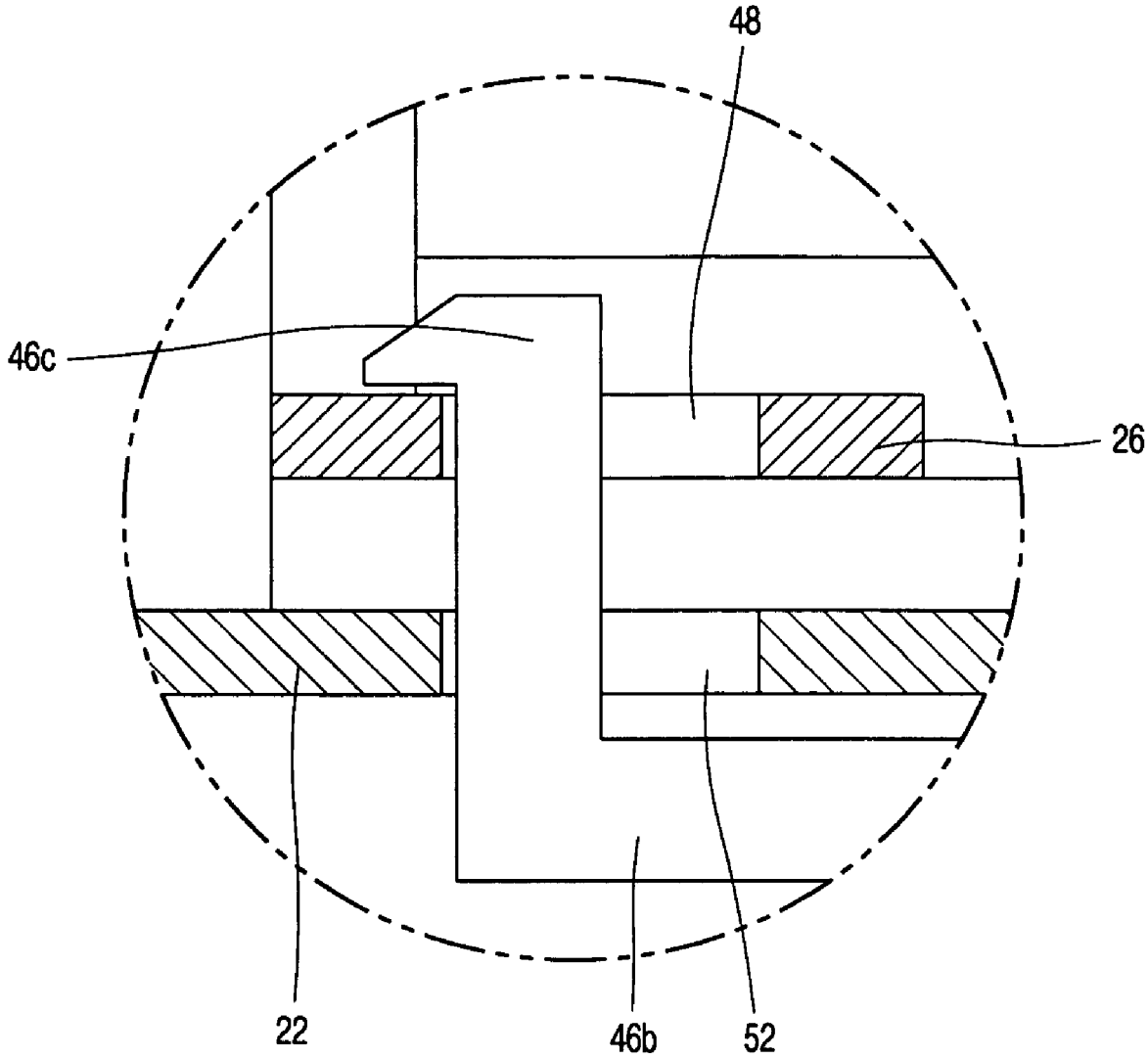
FIG. 7 is an enlargement view of 'B' part of FIG. 6.

FIG. 5 is an enlargement view of 'A' part of FIG. 4, FIG. 6 is a horizontal section view showing a basket lift apparatus of a refrigerator according to one embodiment of the present invention, and FIG. 7 is an enlargement view of 'B' part of FIG. 6.

The locking device is composed of: a locking hook 46 mounted at the lower door 22 to be linearly-moved; a locking hole 48 formed at an upper end of the front side of the frame 26, for locking the locking hook 46; and a spring 50 for providing an elastic force to the locking hook 46 in a direction that the locking hook 46 is locked in the locking hole 48.

The locking hook 46 is composed of: an adjustment portion 46*a* arranged at the hand grip 40 of the lower door 22 and adjusted by a user; a rod portion 46*b* integrally connected to the adjustment portion 46*a* and arranged at an inner side of the lower door 22 to be linearly-moved; and a locking portion 46*c* formed at the end of the rod portion 46*b* and passing through a through hole 44 formed at a rear surface of the lower door 22 thus to be exposed to a rear side of the lower door 22 and to be locked in the locking hole 48.

A pair of the locking hooks 46 are arranged at right and left sides of the lower door 22, and the spring 50 is arranged between the pair of adjustment portions 46*a*.

When the user presses the adjustment portions 46*a*, the rod portion 46*b* is linearly moved and the locking portion 46*c* is separated from the locking hole 48 thereby to release the locking of the lower door 22. The stopping unit is composed of: a rod 52 rotatably connected to a rear surface of the lower door 22 and having a certain length; a stopping hole 54 formed at the frame 26 and passing the rod 52; and a stopping protrusion 56 formed at the end of the rod 52 and stopped in the stopping hole 54.

The rod 52 is preferably formed as a curved surface so that the rod 52 can easily pass through the stopping hole 54 when the lower door 22 is rotated.

When the lower door 22 is rotated, the rod 52 passes through the stopping hole 54, and when the lower door 22 is rotated to the maximum, the stopping protrusion 56 formed at the end of the rod 52 is stopped in the stopping hole 54. According to this, the lower door 22 can maintain the current state.

An operation of a basket lift apparatus according to the present invention will be explained as follows.

Figure 8:
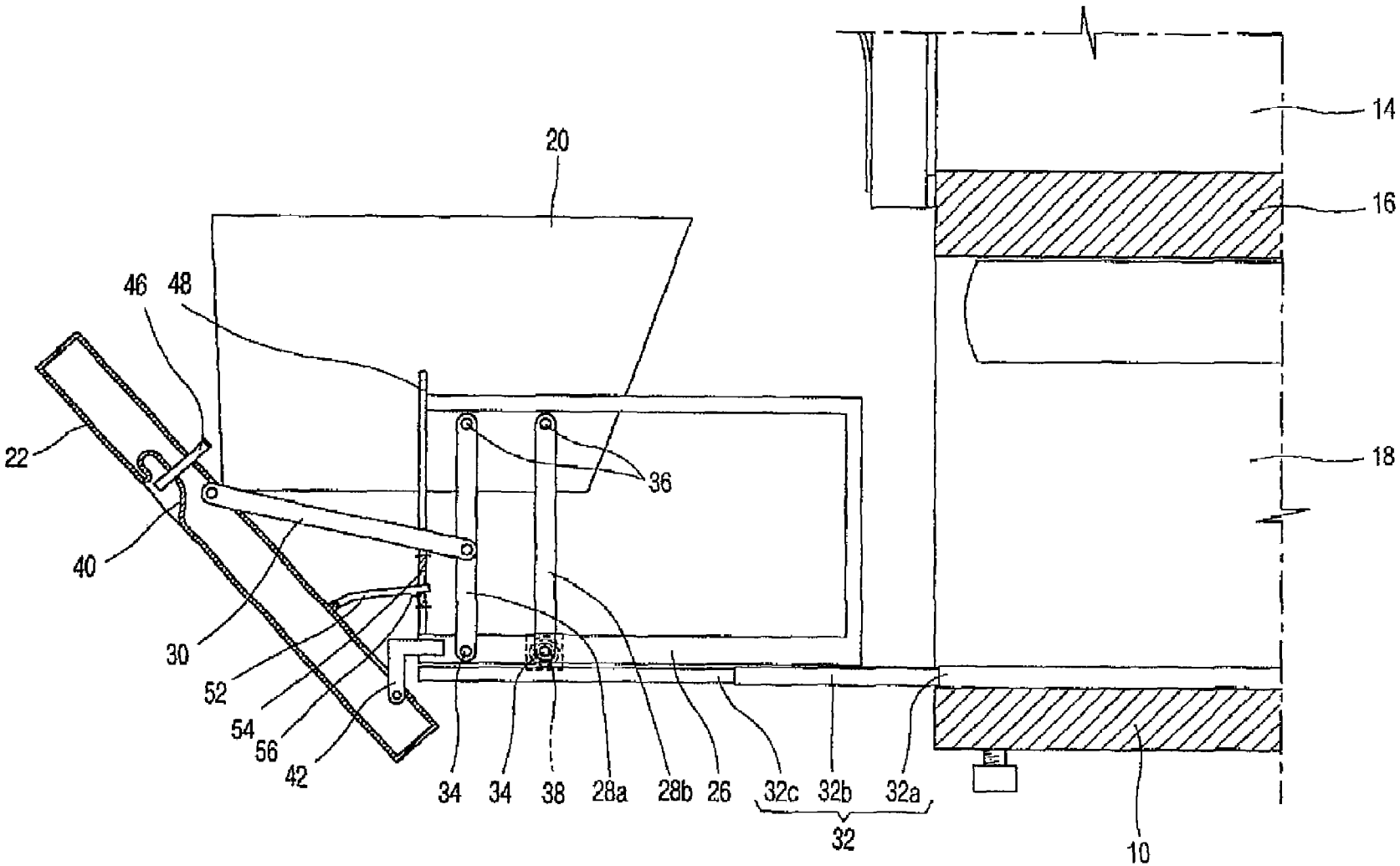
FIG. 8 is an operation state view of the basket lift apparatus according to one embodiment of the present invention.

FIG. 8 is an operation state view of the basket lift apparatus according to one embodiment of the present invention.

When the user pulls the lower door 22 by holding the hand grip 40, the frame 26 is slid along the guide rail 32 thereby to be drawn out of the lower cooling chamber 18. At this time, the basket 20 positioned on the frame 26 is exposed to the outside.

Under this state, when the user operates the locking hook 46 of the locking unit, the locking between the lower door 22 and the frame 26 is released. That is, when the user presses the adjustment portion 46*a* of the locking hook 46, the locking portion 46*c* is separated from the locking hole 48 formed at the frame 26 thereby to release the locking of the lower door 22.

When the lower door 22 is forwardly rotated, the four-joint link unit hinge-connected between the lower door 22, the frame 26, and the basket 20 is operated thereby to lift the basket 20. That is, when the lower door 22 is rotated, the second link 30 connected to the lower door 22 is rotated together with the lower door 22. As the second link 30 is rotated, the first links 28*a* and 28*b* hinge-connected between the basket 20 and the frame 26 become upright thereby to lift the basket 20.

At this time, the basket 20 is lifted more easily by an elastic force of the spring 38 mounted at the first links 28*a* and 28*b* thereby to enhance the user's convenience.

When the basket 20 is lifted to the maximum, the stopping unit mounted between the lower door 22 and the basket 20 is operated thus to prevent the lower door 22 from being rotated to the original state and thereby to maintain the lifted state of the basket 20.

On the contrary, when the basket 20 is to be descended, the stopping of the stopping unit is released and then the basket 20 is downwardly pressed. According to this, the basket 20 is placed at an upper surface of the basket 20. At this time, the locking unit is operated thereby to maintain the descended state of the basket 20.

Figure 9:
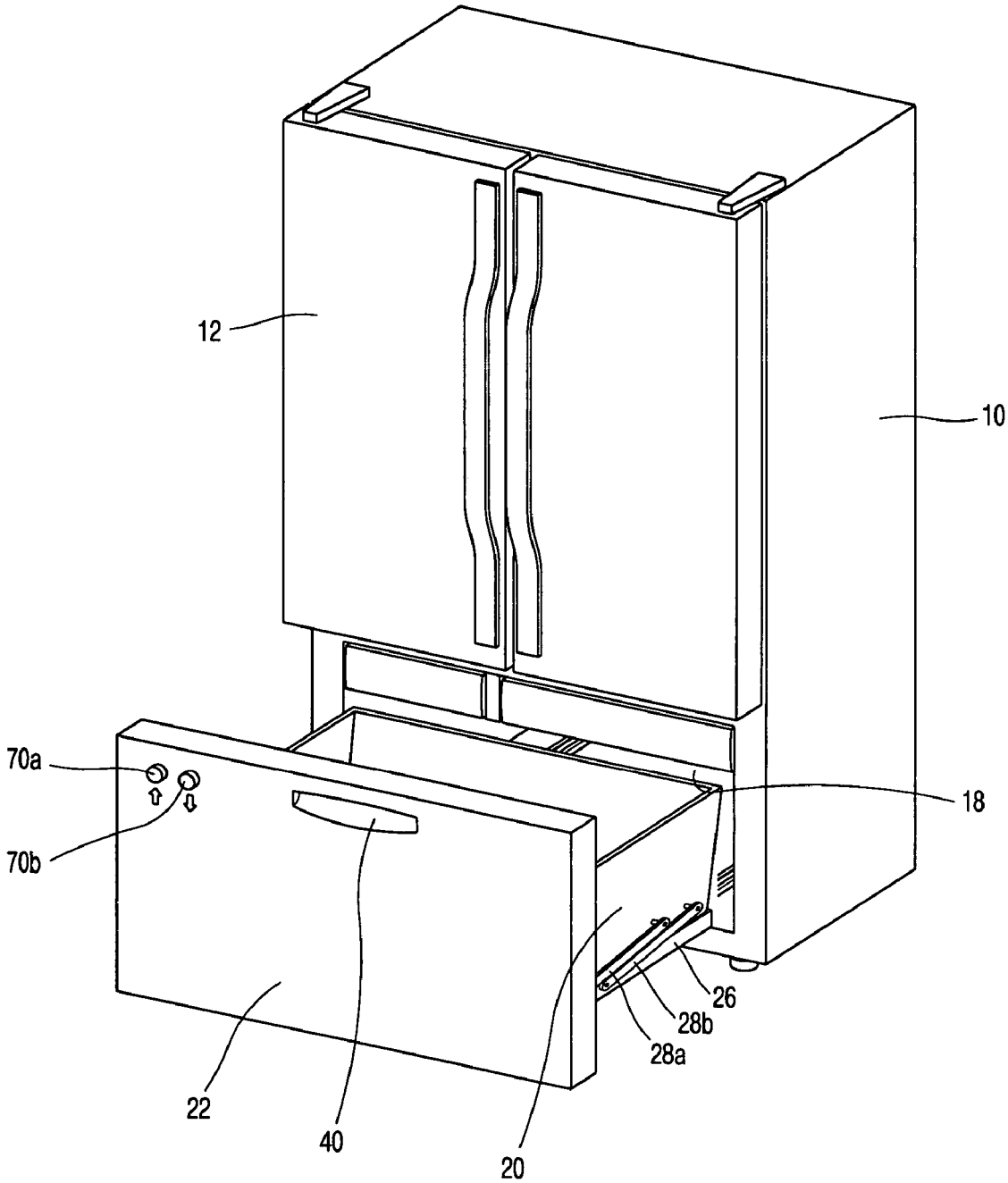
FIG. 9 is a perspective view showing a refrigerator having a basket lift apparatus according to a second embodiment of the present invention.
Figure 10:
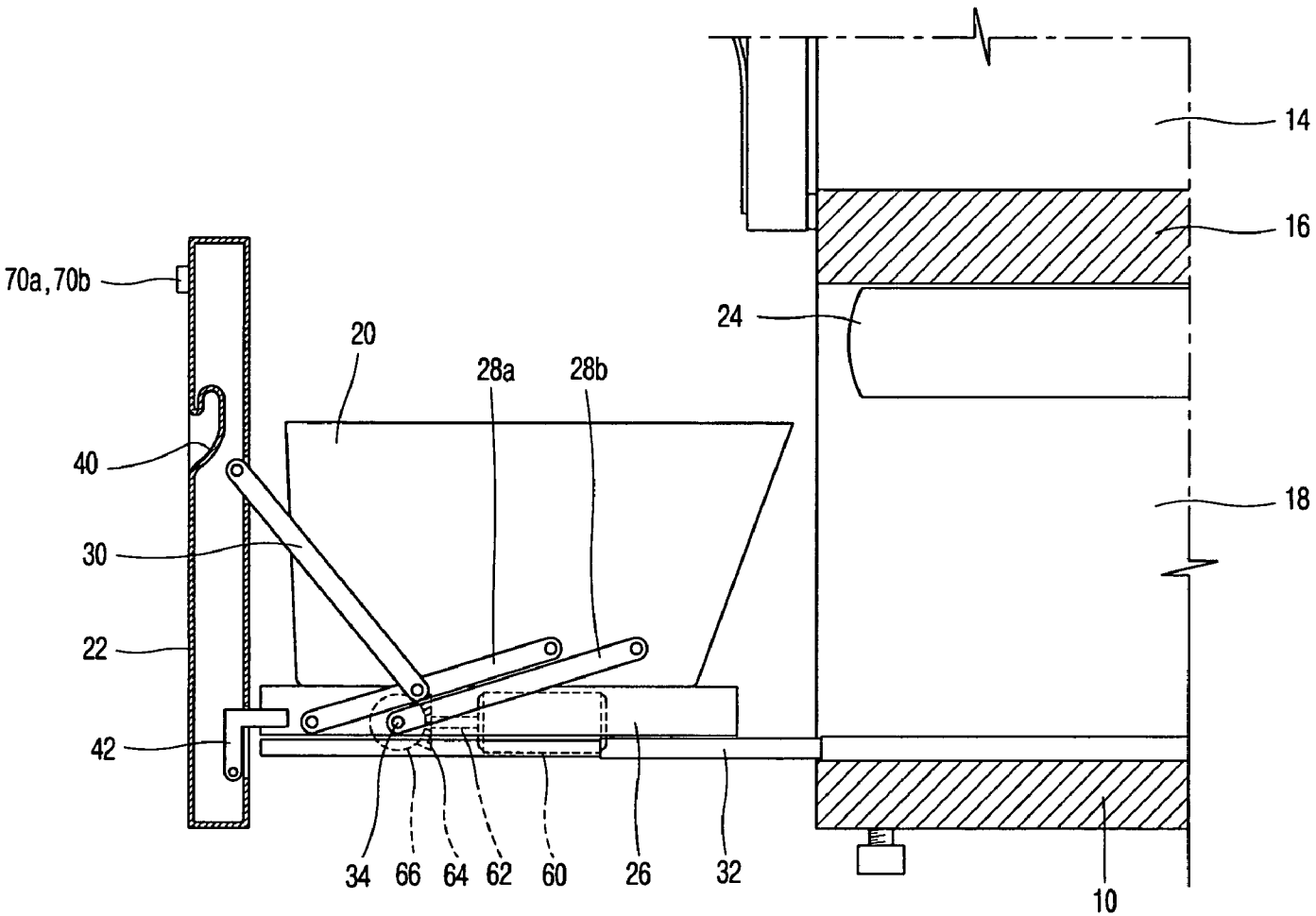
FIG. 10 is a lateral view showing the basket lift apparatus according to the second embodiment of the present invention.
Figure 11:
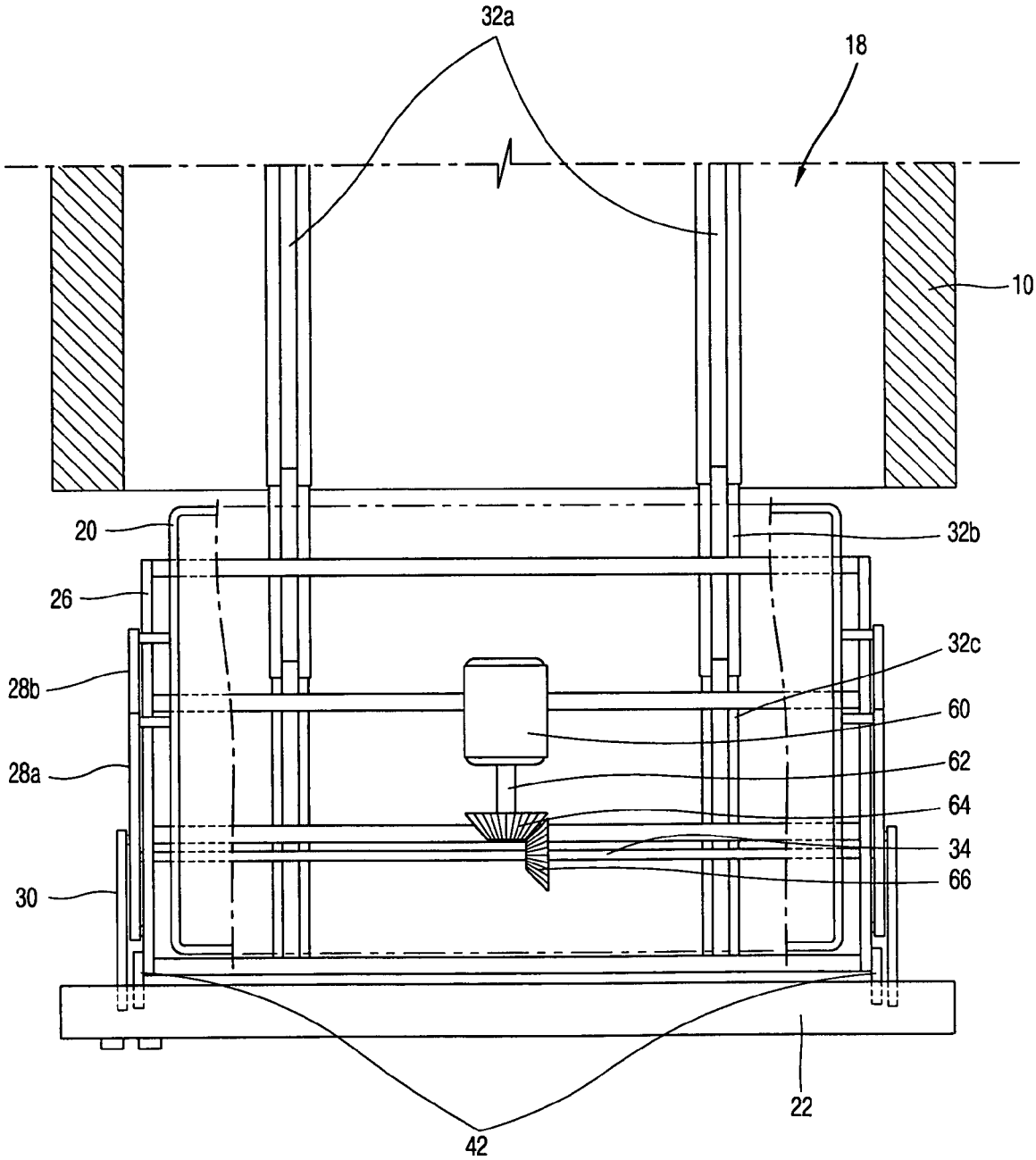
FIG. 11 is a sectional view showing the basket lift apparatus according to the second embodiment of the present invention.

FIG. 9 is a perspective view showing a refrigerator having a basket lift apparatus according to a second embodiment of the present invention, FIG. 10 is a lateral view showing the basket lift apparatus according to the second embodiment of the present invention, and FIG. 11 is a sectional view showing the basket lift apparatus according to the second embodiment of the present invention.

The basket lift apparatus according to the second embodiment of the present invention comprises: a frame 26 arranged at the lower cooling chamber 18 to be slidable back and forth, on which a basket 20 is placed, and to the front side thereof a lower door 22 is hinge-connected; a plurality of first links 28*a* and 28*b* hinge-connected between the basket 20 and the frame 26, for supporting a lifted state of the basket 20; a second link 30 hinge-connected between one of the first links 28*a* and 28*b* and the lower door 22, for lifting the basket 20 when the lower door 22 is forwardly inclined; a driving unit for rotating the first links 28*a* and 28*b* in order to automatically lift the basket 20; and a controlling unit for controlling the driving unit.

The frame 26, the first links 28*a* and 28*b*, and the second link 30 have the same structures and operations as those aforementioned in the first embodiment thereby to omit the explanations.

The driving unit is composed of: a driving motor 60 mounted at the frame 26 and generating a driving force; and a power transmitting unit for transmitting a driving force generated from the driving motor 60 to one of the first links 28*a* and 28*b*.

The power transmitting unit is composed of: a driving gear 64 fixed to a rotation shaft 62 of the driving motor 60 and rotated together with the rotation shaft; and a driven gear 66 gear-engaged with the driving gear 64 and fixed to a hinge shaft 34 at which one end portion of the first link 28*b* is mounted. Since the driving motor 60 and the hinge shaft 34 are arranged to be perpendicular to each other, the driving gear 64 and the driven gear 66 are constructed as a bevel gear for transmitting a power as much as 90°.

Figure 12:
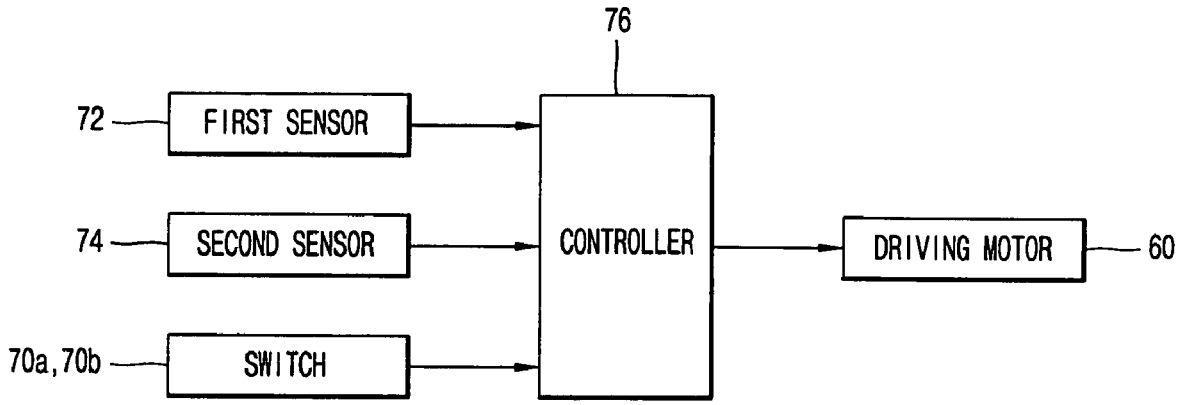
FIG. 12 is a block diagram showing a controlling unit of the basket lift apparatus according to the second embodiment of the present invention.

As shown in FIG. 12, the controlling unit is composed of: switches 70*a* and 70*b* mounted at the lower door 22, for driving the driving motor 60 in a forward direction or a backward direction by a user's adjustment; a first sensor 72 for sensing a state that the basket 20 is lifted to the maximum; a second sensor 74 for sensing a state that the basket 20 is descended to the maximum; and a controller 76 for controlling an operation of the driving motor 60 according to a signal applied from the switches 70*a* and 70*b*, the first sensor 72, and the second sensor 74.

The switches are composed of: a first switch 70*a* mounted at the front side of the lower door 22 and adjusted by the user when the basket 20 is to be lifted; and a second switch 70*b* adjusted by the user when the basket 20 is to be descended.

The first sensor 72 and the second sensor 74 can be mounted at any position where a lifted state or a descended state of the basket 20 can be sensed. Also, any sensor that can sense a lifted state or a descended state of the basket 20 can be applied as the first sensor 72 and the second sensor 74.

Figure 13:
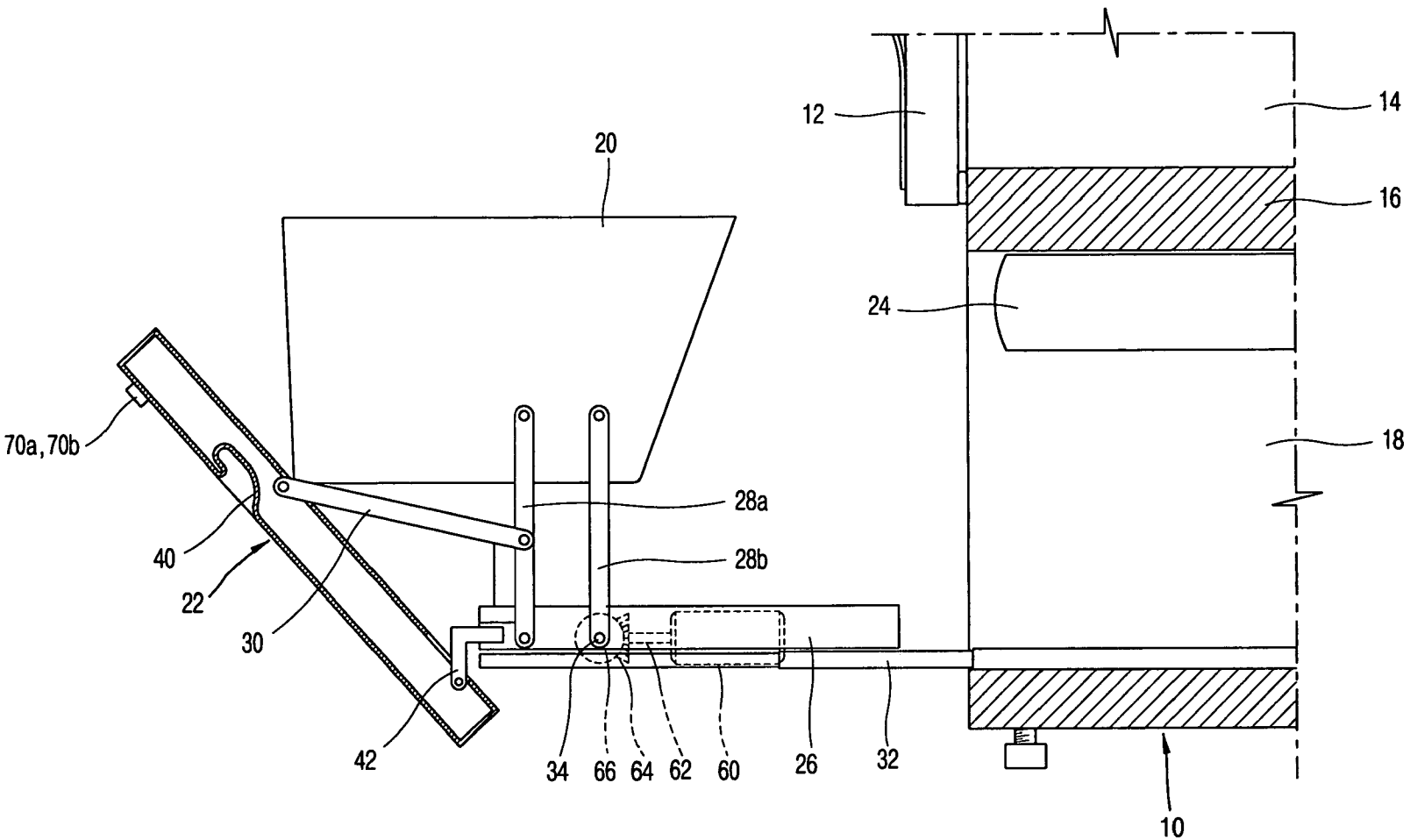
FIG. 13 is an operation state view of the basket lift apparatus according to the second embodiment of the present invention.

FIG. 13 is an operation state view of the basket lift apparatus according to the second embodiment of the present invention.

An operation of the basket lift apparatus according to the second embodiment of the present invention will be explained as follows.

When the user pulls the lower door 22 by holding the hand grip 40, the frame 26 is slid along the guide rail 32 thereby to be drawn out of the lower cooling chamber 18. At this time, the basket 20 positioned on the frame 26 is exposed to the outside.

Under this state, when the user presses the first switch 70*a*, the controller 76 drives the driving motor 60 in a forward direction. Then, a driving force of the driving motor 60 is transmitted to the hinge shaft 34 by the power transmitting unit. As the hinge shaft 34 is rotated, the driving motor 60 is rotated in a direction that the first link 28*b* becomes upright and thereby the basket 20 connected to the first links 28*a* and 28*b* is lifted. When the basket 20 is lifted to the maximum, the first sensor 72 senses a position of the basket 20 and applies a signal indicating the position to the controller 76. Then, the controller 76 stops the operation of the driving motor 60.

When the user presses the second switch 74 after storing food in the basket 20 under a state that the basket 20 is lifted to the maximum, the controller 76 drives the driving motor 60 in a backward direction. According to this, the driving motor 60 is rotated in a direction that the first links 28*a* and 28*b* lie down, and the basket 20 is descended thus to be placed on the upper surface of the frame 26. At this time, the second sensor 74 senses a position of the basket 20 and applies a signal indicating the position to the controller 76. Then, the controller 76 stops the operation of the driving motor 60.

Figure 14:
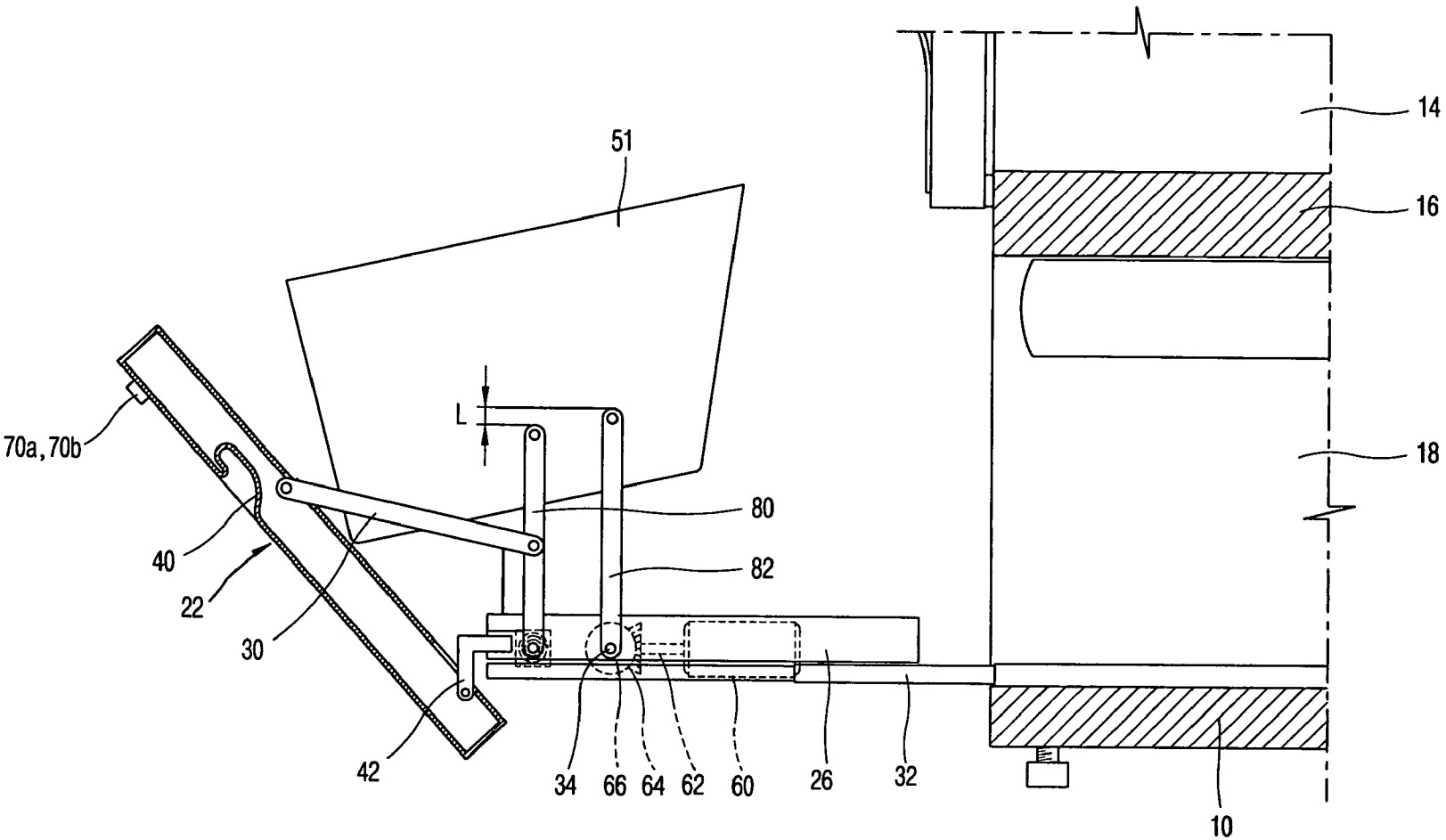
FIG. 14 is a lateral view showing a basket lift apparatus according to a third embodiment of the present invention.

FIG. 14 is a lateral view showing a basket lift apparatus according to a third embodiment of the present invention.

The basket lift apparatus according to the third embodiment of the present invention has the same construction as the basket lift apparatus according to the second embodiment of the present invention except that a pair of first links 80 and 82 are constructed and one first link 80 is shorter than another first link 82.

The basket lift apparatus according to the third embodiment of the present invention is for enhancing the user's convenience by inclining the basket 20 forwardly as much as a certain angle when the basket 20 is lifted. In the basket lift apparatus according to the third embodiment, the first link 82 positioned at the rear side of the basket 20 is formed to be longer than the first link 82 positioned at the front side of the basket 20 as much as the length L.

Effects of the refrigerator having a basket lift apparatus according to the present invention will be explained as follows.

As the basket is drawn out of the lower cooling chamber and then the lower door is rotated, the basket is lifted thereby to enhance the user's convenience.

Also, as the user draws the basket out of the lower cooling chamber and then presses the switch, the basket is automatically lifted thereby to enhance the user's convenience.

Additionally, as the basket is forwardly inclined at the time of being lifted, the user can store food in the basket or take food out of the basket more conveniently.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A refrigerator comprising:

a body having a cooling chamber;

a frame arranged at the cooling chamber and on which a basket for storing food is positioned;

a door positioned at a front side of the frame and hinge-connected to the frame; and a link unit link-connected between the frame and the basket or between the basket and the door, the link unit being configured to lift the basket and to move the basket horizontally with respect to the frame when the door is rotated, wherein the link unit comprises:

a first link connected between the frame and the basket for guiding the basket to be lifted and supporting a lifted state of the basket; and a second link connected between the first link and the door for lifting the basket when the door is forward rotated.

2. The refrigerator of claim 1, wherein the frame is arranged at the cooling chamber to be movable in back and forth directions of the body.

3. The refrigerator of claim 1, further comprising a guide rail installed between the frame and the cooling chamber for guiding the frame to be slid in back and forth directions of the body.

4. The refrigerator of claim 1, wherein the door has a lower end hinge-connected to the frame by a hinge-bracket.

5. The refrigerator of claim 1, wherein the first link has one end hinge-connected to the frame and another end hinge-connected to the basket.

6. The refrigerator of claim 5, wherein the link unit includes a third link having one end hingedly connected to the basket and another end hingedly connected to the frame.

7. The refrigerator of claim 6, wherein the first and third link are arranged substantially parallel throughout the lifting of the basket.

8. The refrigerator of claim 1, wherein a spring for providing an elastic force to the first link is installed at the hinge-connected portion between the first link and the frame.

9. The refrigerator of claim 1, wherein the first link is constructed as one pair, and one first link is longer than another first link.

10. The refrigerator of claim 1, further comprising a locking unit for locking the door to the frame not to rotate the door or releasing a locked state of the door.

11. The refrigerator of claim 10, wherein the locking unit comprises:

a locking hole formed at a front side of the frame;

a locking hook movably mounted at the door and locked in the locking hole; and a spring for providing an elastic force to the locking hook so that the locking hook can maintain a locked state in the locking hole.

12. The refrigerator of claim 11, wherein the locking hook comprises:

a lever portion exposed to a front side of the door and adjusted by a user;

a connecting portion integrally connected to the lever portion and movably mounted at the door; and a locking portion formed at an end of the connecting portion and locked by the locking hook.

13. The refrigerator of claim 1, further comprising a stopping unit installed between the frame and the door for preventing the door from being returned to an original state after a rotation.

14. The refrigerator of claim 13, wherein the stopping unit comprises:

a rod rotatably connected to the door and having a certain length;

a stopping hole formed at the frame for passing the rod; and a stopping protrusion formed at an end of the rod and stopped in the stopping hole.

15. The refrigerator of claim 1, wherein the link unit is configured to lift the basket along an arcuate path.

16. A refrigerator comprising:

a body having a cooling chamber;

a frame arranged at the cooling chamber and on which a basket for storing food is positioned;

a door positioned at a front side of the frame and hinge-connected to the frame;

a link unit link-connected between the frame and the basket or between the basket and the door, the link unit being configured to lift the basket and to move the basket horizontally with respect to the frame when the door is rotated; and a driving unit for driving the link unit so as to lift the basket, wherein the link unit comprises:

a first link connected between the frame and the basket for guiding the basket to be lifted and supporting a lifted state of the basket; and a second link connected between the first link and the door for lifting the basket when the door is forward rotated.

17. The refrigerator of claim 16, wherein the frame is arranged at the cooling chamber to be movable in back and forth directions of the body.

18. The refrigerator of claim 16, wherein the first link has one end hinge-connected to the frame and another end hinge-connected to the basket.

19. The refrigerator of claim 18, wherein the link unit includes a third link having one end hingedly connected to the basket and another end hingedly connected to the frame.

20. The refrigerator of claim 19, wherein the first and third link are arranged substantially parallel throughout the lifting of the basket.

21. The refrigerator of claim 16, wherein the first link is constructed as one pair, and one first link is longer than another first link.

22. The refrigerator of claim 16, wherein the driving unit comprises:

a driving motor mounted at the frame for generating a driving force; and a power transmitting unit for transmitting a driving force generated from the driving motor to a hinge shaft to which the first link is connected.

23. The refrigerator of claim 22, wherein the power transmitting unit comprises:

a driving gear fixed to a rotation shaft of the driving motor and together rotated; and a driven gear fixed to the hinge shaft and gear-engaged with the driving gear.

24. The refrigerator of claim 16, further comprising a control unit for controlling the driving unit by a user's adjustment.

25. The refrigerator of claim 24, wherein the control unit comprises:

a switch mounted at the door and adjusted by a user;

a first sensor for sensing a position that the basket is lifted to the maximum;

a second sensor for sensing a position that the basket is descended to the maximum; and a controller for controlling the driving motor according to a signal applied from the switch, the first sensor, and the second sensor.

26. The refrigerator of claim 16, wherein the link unit is configured to lift the basket along an arcuate path.

* * * * *